United States Patent [19]

Hamilton

[11] Patent Number: 4,819,137

[45] Date of Patent: Apr. 4, 1989

[54] MULTI-PURPOSE SELF DEFENSE APPARATUS

[76] Inventor: Robert J. Hamilton, 412 Ocean Heights Ave., Linwood, N.J. 08221

[21] Appl. No.: 208,831

[22] Filed: Jun. 15, 1988

Related U.S. Application Data

[63] Continuation of Ser. No. 11,129, Feb. 5, 1987, abandoned, which is a continuation-in-part of Ser. No. 810,608, Dec. 19, 1985, abandoned.

[51] Int. Cl.[4] ..... A45B 3/04; A63B 15/02

[52] U.S. Cl. ..... 362/102; 59/95; 272/124

[58] Field of Search ..... 362/102, 457, 399, 419, 362/434; 43/91; 464/125; 16/127; 59/95; 272/124, 75, 61

[56] References Cited

U.S. PATENT DOCUMENTS

| | | | |
|---|---|---|---|
| 109,666 | 11/1870 | Richards | 59/95 |
| 238,391 | 3/1881 | Homer | 59/95 |
| 786,040 | 3/1905 | Liberman et al. | 362/102 |
| 791,376 | 5/1905 | Somes | 362/102 |
| 849,216 | 4/1907 | Diehl et al. | 362/102 |
| 898,789 | 9/1908 | Schleicher | 59/95 |
| 916,127 | 3/1909 | Eldridge | 59/95 |
| 1,018,358 | 2/1912 | Litsey | 362/102 |
| 1,066,540 | 7/1913 | Smithwick | 362/102 |
| 1,130,355 | 3/1915 | Von Eschen | 362/102 |
| 1,183,282 | 5/1916 | Dinges | 302/102 |
| 1,206,095 | 11/1916 | Coy | 362/102 |
| 1,262,736 | 4/1918 | Ballvu, Jr. | 59/95 |
| 1,489,305 | 4/1924 | Calkins | 362/102 |
| 2,257,227 | 9/1941 | Dater | 362/102 |
| 2,260,639 | 10/1941 | Powell | 362/102 |
| 2,719,038 | 9/1955 | Mossa | 272/124 |
| 2,758,440 | 8/1956 | Magid | 59/95 |
| 3,371,930 | 3/1968 | Shiga | 272/124 |
| 3,454,274 | 7/1969 | Kanishiro | 272/75 |
| 4,080,782 | 3/1978 | Colecchio | 59/95 |
| 4,236,544 | 12/1980 | Osaka | 362/102 |
| 4,479,171 | 10/1984 | Mains | 362/102 |
| 4,647,037 | 3/1987 | Donohue | 272/75 |

FOREIGN PATENT DOCUMENTS

| | | | |
|---|---|---|---|
| 763454 | 5/1934 | France | 362/102 |
| 802983 | 9/1936 | France | 362/102 |
| 322091 | 5/1957 | France | 362/102 |
| 265020 | 12/1927 | Italy | 362/102 |

OTHER PUBLICATIONS

"Black Belt" Martial Arts Magazine, Ads from pp. 64 and 112, Oct. 1987 Issue.

"Romatron" pamphlet for Adult Key Chain & 5 Mode Self Defense System (Copywrite: Bontron, Inc. 1986).

Black Belt magazine published in Feb. of 1987.

*Primary Examiner*—Raymond A. Nelli

*Attorney, Agent, or Firm*—William H. Murray

[57] ABSTRACT

A self defense baton comprises a handle portion which includes a central portion and a housing member connected to one end of the central portion. A flashlight portion is connected to the other end of the central portion. At least one telescoping member is slidably disposed within the housing member. The telescoping member is spring loaded and retained within the housing member by a releasable latch. A ring is rotatably attached to the handle portion. To use, the handle portion is grasped with a finger of the grasping hand being inserted through the ring. The releasable latch is activated by the thumb of the grasping hand. A spring, disposed within the housing member, causes the telescoping member to slide out of the housing member thereby expanding the baton. The rotatably attached ring enables rapid manipulation of the baton without risking accidental loss of the baton during these manipulations. The ring may also double as a key ring without loss of maneuverability of the baton.

8 Claims, 1 Drawing Sheet

MULTI-PURPOSE SELF DEFENSE APPARATUS

BACKGROUND OF THE INVENTION

This application is a continuation of application Ser. No. 011,129, filed Feb. 5, 1987, now abandoned, which is a continuation in part of co-pending U.S. patent application Ser. No. 810,608, filed Dec. 19, 1985, now abandoned.

This invention relates to self defense apparatus and more particularly to a combination expandable baton and flashlight having improved handling means.

Batons, sometimes known as night sticks or billy clubs, have been proven effective for warding off attackers. Combining such batons with flashlights provides the additional advantage of having a light source for signaling or searching. Combinations of batons and lights are shown, for example, in U.S. Pat. Nos. 1,489,305 and 2,260,639. The major difficulties with the apparatuses disclosed in these patents are that they are too bulky to be conveniently carried in pocket or purse and they are relatively difficult to handle and manipulate. This latter difficulty can cause a severe compromise in the effectiveness of the apparatus for self defense.

Attempts have been made to facilitate handling and manipulation of batons. One such attempt, the use of a side handle, is disclosed in U.S. Pat. No. 4,479,171. However, the addition of a side-handle makes this apparatus even more bulky than its predecessors and therefore even more inconvenient to carry. Furthermore, the baton could slip out of the users hand while attempting to manipulate it during a confrontation with an attacker. Although U.S. Pat. No. 257,227 discloses the use of a wrist strap to secure the night stick in place, its use is problematical in that quickly reobtaining an effective grip on the night stick could prove difficult while the night stick is wildly swinging about the wrist strap during the heat of a confrontation.

SUMMARY OF THE INVENTION

Therefore, it is an object of the present invention to provide a baton having a relatively small size for ease in carrying on the person while being expandable for use.

It is another object of the present invention to provide a baton having an improved handling and gripping means.

It is yet another object of the present invention to provide a baton, in combination with a flashlight, which may be collapsed to relatively small dimensions.

It is still another object of the present invention to provide a baton including means for preventing the baton from slipping out of the hand of the user, which means are also effective to enhance the maneuverability of the baton.

It is a further object of the present invention to provide a multipurpose baton having means for preventing the baton from slipping out of the hand of the user, which means also serves as key retaining means.

These and other objects of the present invention will become apparent to those skilled in the art upon consideration of the following description of one form of the invention.

The present invention is directed to an expandable baton having a flashlight disposed in one end thereof. The baton comprises at least one spring-loaded, telescoping member which slides into the handle when the baton is collapsed. A ring is rotatably attached to the side of the handle. The telescoping member has a quick release which is operable by a thumb or finger of a person grasping the device. In use, the user grasps the device, inserting one of the fingers of the grasping hand through the ring. In the preferred embodiment, the user operates the quick release means by rotating the end of the telescoping portion with the thumb of the grasping hand. The spring causes the telescoping portion to extend to its limit. By releasing the grasp on the handle, while maintaining the finger through the ring, the baton may be rotated by the user thereby changing the orientation of the extended portion with respect to the hand, without releasing control of the baton. In this way, the baton can be quickly manipulated as required for self defense. The ring is also useable as a key ring for retaining keys thereon.

DETAILED DESCRIPTION OF THE PREFERRED EMBODIMENT

Figure 1:
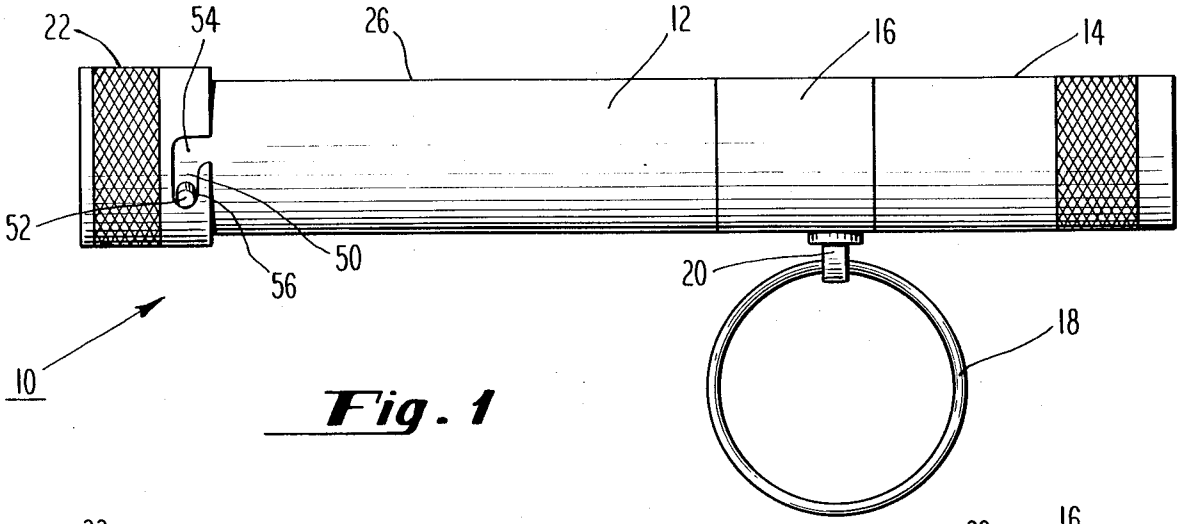
FIG. 1 is a side view of a preferred embodiment of the baton of the present invention in its collapsed configuration.

Referring now to FIG. 1, there is shown a side view of the preferred embodiment of the baton of the present invention, generally designated 10. The baton 10 comprises a handle portion 12, which includes a central portion 16 and a housing member 26 connected to one end of the central portion 16. A flashlight portion 14 is connected to the other end of the central portion 16. A ring 18 is rotatably attached to the central portion 16 by means of a swivel member 20. Although the ring 18 is attached to the central portion 16 in the preferred embodiment, it could alternatively be rotatably connected elsewhere on the handle portion 12.

Figure 2:
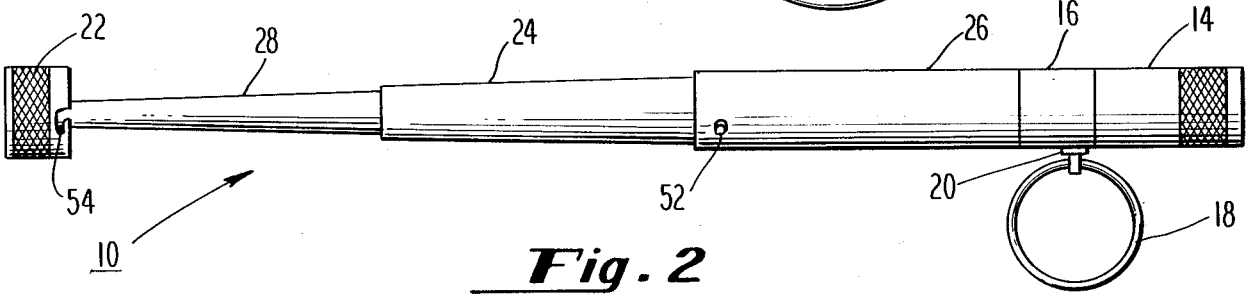
FIG. 2 is a side view of a preferred embodiment of the baton of the present invention in its expanded configuration.

Referring now to FIG. 2, there is shown the baton 10 in its expanded configuration. A first telescoping member 24 is slidably disposed within the housing member 26. A second telescoping member 28 is slidably disposed within the first telescoping member 24. A tip member 22 is mounted on the end of the second telescoping member 28.

Figure 3:
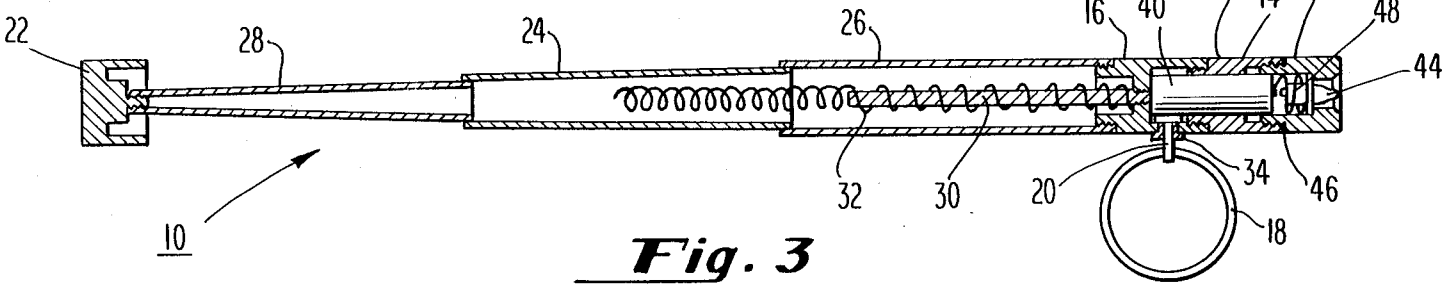
FIG. 3 is a fragmentary sectional view taken along the longitudinal mid-line of expanded configuration the baton depicted in FIG. 2.

Referring now to FIG. 3, there is shown a partial midline sectional view of the baton 10 in its expanded configuration; that is, with the telescoping members 24 and 28 extending outwardly from the surrounding members 26 and 24 respectively. The collapsed configuration of preferred embodiment of the baton 10 is herein defined as that configuration wherein the telescoping members 24 and 28 are nested or disposed within the surrounding members 26 and 24 respectively. FIG. 1 depicts the preferred embodiment of the baton 10 of the present invention in its collapsed configuration. A spring guide rod 30 is mounted within, and in substantially coaxial alignment with the housing member 26. In the embodiment shown in FIG. 3, one end of the rod 30 is threaded and inserted into a threaded aperture in the central portion 16. At least a portion of a release spring 32 is disposed around the spring guide rod 30.

The swivel member 20 comprises a bushing 34 which is secured within an aperture in the central portion 16. A swivel pin 36 is rotatably mounted through an aperture in the bushing 34. The ring 18 is rotatably mounted through an aperture in the swivel pin 36. As a result, the ring 18 is free to rotate 360 degrees about an axis which is substantially perpendicular to the longitudinal axis of the baton 10. The ring 18 can also swivel about axes which are contained in a plain substantially perpendicular to the aforementioned axis of rotation. In the embodiment shown in FIG. 3, the tip member 22 is screwed into the end of the second telescoping member 28.

The flashlight portion 14 comprises a battery housing 38 having a hollow central portion for receiving a battery 40. The battery housing 38 is screwed into the central portion 16. The flashlight portion 14 also includes a bulb housing 42 having a hollow central portion which is adapted to receive a bulb 44. The end of the bulb housing 42 has an aperture therein through which the tip of the bulb 44 extends . Bulb housing 42 is attached to the battery housing 38 by means of mating threads. A compressable O-ring 46 is disposed around a shoulder of the bulb housing 42 between bulb housing 42 and the battery housing 38. The compressable O-ring 46 permits the bulb housing 42 to be screwed into the battery housing 38 for a distance required to cause physical and electrical contact between the bulb 44 and the battery 40. A bulb spring 48 is disposed around the base of the bulb 44 and maintains the bulb 44 in spaced apart relationship with respect to the battery 40 when the bulb housing 42 has been unscrewed away from the battery housing 38.

The housing member 26, first telescoping member 24 and second telescoping member 28 are preferably tapered from a larger end which, in the preferred embodiment is closest to the flashlight portion 14, to a smaller end such that the larger end of the inner member seats in a friction fitting relationship against the smaller end of the outer member when in the expanded position thereby preventing the inner member from slipping out of the outer member. In the preferred embodiment, the taper of each member is one degree. Therefore, as shown in FIG. 3, the end of the first tapered telescoping member 24 closest the flashlight portion 14 seats within the end of the tapered housing member 26 farthest from the flashlight portion 14.

Simularly, the end of the second tapered telescoping member 28 nearest the flashlight portion 14 seats within the end of the first tapered telescoping member 24 farthest from the flashlight portion 14 when in the expanded configuration. When expanded, these friction fits between the first telescoping member 24 and housing member 26, and the second telescoping member 28 and the first telescoping member 24 enable the telescoping members to remain fixed in the expanded configuration. To release, a compression force is applied which overcomes the friction fits. An alternate preferred embodiment, the release spring 32 could extend, at least partially under compression, all the way out to the tip member 22 in order to maintain the baton in its expanded configuration.

Although the description of the preferred embodiment discloses the use of tapered housing and telescoping members, non-tapered members could also be used. In such an alternate configuration, the inner members are prevented from slipping out of their respective surrounding members by means of, for example, overlapping shoulders. In this alternate configuration, the telescoping members are maintained in the expanded configuration by means of a release spring which extends, under compression, from the central portion 16 to the tip member 22 when the baton 10 is in its expanded configuration. Such an alternate preferred embodiment is considered to be within the scope and contemplation of the present invention.

In the preferred embodiment, the central portion 16, the housing member 26, the tip member 22, the swivel member 20, the first telescoping member 24, the second telescoping member 28, the ring 18, the spring guide rod 30 and the springs 32 and 48 are constructed of steel. The battery housing 38 and bulb housing 42 are constructed of aluminum.

The baton 10 of the present invention operates as follows. The baton is placed in its collapsed configuration by exerting a compression force on the tip member 22 in a direction toward the flashlight portion 14 thereby causing the first telescoping member 24 to slide into the housing member 26 and the second telescoping member 28 to slide into the first telescoping member 24. This compression force overcomes a force exerted in the opposite direction by the release spring 32. The baton is maintained in its collapsed configuration by a releasable latching means such as, for example, a bayonet latch 50 (see FIG. 1). The bayonet latch 50 comprises a pin member 52 which extends from the housing member 26 as shown in FIGS. 1 and 2. The pin member 52 is secured within a groove 54 in the tip member 22. When collapsing the telescoping portion 12 of the baton 10, the pin member 52 is guided into the groove 54. The tip member 22 is then turned thereby causing the pin member 52 to be retained within a detent portion 56 of the groove 54. This causes the baton 10 to be maintained in the collapsed configuration shown in FIG. 1.

To expand the baton, the user grasps the baton around the handle portion 12. One of the fingers on the grasping hand is inserted through the ring 18. Although any finger of the grasping hand can be used, it has been found preferable to insert the middle finger through the ring 18. The baton is then quickly expanded by rotating the tip member 22 with the thumb of the grasping hand causing the pin 52 to be released from the groove 54 of the bayonet latch 50. The force of release spring 32, which is compressed in the collapsed configuration, causes the first 24 and second 28 telescoping members to quickly extend to their limits which are defined by the engaged ends of their tapers as previously described.

Although the releasable retaining means comprises a bayonet latch 50 in the preferred embodiment, other types of releasable retaining means, such as a spring loaded detent latch, operable by the thumb, are also useable and are considered to be within the scope and contemplation of the present invention.

The baton can be quickly and efficiently manipulated by means of the ring 18 through which one of the fingers of the grasping hand is extended. To manipulate, the user releases his grasp and spins the baton about the swivel member 20. Since the swivel member 20 enables the ring to rotate 360 degrees with respect to the baton as previously described, the baton can be continuously twirled, if so desired, to fend off and confuse a would-be attacker. The swiveling ring also enables the user to rapidly rotate the baton 180 degrees thereby quickly repositioning the grasp and enabling the user to ward off blows originating from practically any direction.

The swivelled ring 18 enables rapid manipulation of the baton 10 without fear of losing grasp of the baton as a result of these rapid manipulations since the finger of the users hand remains securely placed within the swivelling ring while the baton is being manipulated to its desired positions.

The ring 18 can also double as a key ring without losing its effectiveness in enabling the rapid manipulation of the baton 10. Such a key ring can have, for example, a split ring configuration which permits the keys to be attached to the ring. Other types of key rings can also be used and are considered to be within the scope and contemplation of the present invention.

When a light source is required, the flashlight portion 14 of the baton 10 is operated by twisting the bulb housing thereby causing the O-ring 46 to compress. This advances the bulb 44 toward the battery 40 until electrical contact is made therebetween, causing the bulb to illuminate. To extinguish the light, the bulb housing 42 is turned in the opposite direction until contact between the bulb and the battery is broken. The bulb spring 48 maintains the bulb 44 spaced from the battery 40. Although the preferred embodiment utilizes a twistable bulb housing for activating the flashlight portion 14, alternate light activation means, such as a slide switch disposed on the surface of the battery housing 38 or the bulb housing 32 or elsewhere on the handle portion 12, are also useable and such alternate light activation means are considered to be within the scope and contemplation of the present invention.

As can be seen from the above detailed description of the preferred embodiment, the baton 10 of the present invention is collapsable for ease in carrying, and is rapidly expandable when necessary for use. The swivelling ring 18 enables the baton to be rapidly and efficiently manipulated during use while at the same time preventing accidental loss of the baton during such manipulations. The baton also serves as a source of illumination and the ring 18 may double as a key ring without loss of maneuverability of the baton.

It will be understood that the various changes in the details, materials, and arrangement of the parts which have been described and illustrated in order to explain the nature of this invention, may be made by those skilled in the art without departing from the principle and scope of the invention as expressed in the following claims.

I claim:

1. A multi-purpose self defense baton comprising:

(a) a handle portion including:
  (i) a central portion; and
  (ii) a housing member connected to one end of said central portion;

(b) a flashlight portion connected to the other end of said central portion;

(c) at least one telescoping member slidably disposed within said housing member;

(d) a tip member replaceably attached to a distal end of said at least one telescoping member, said tip member having a periphery which extends beyond the periphery of said at least one telescoping member;

(e) means for expanding said at least one telescoping member, said expanding means including:
  (i) a spring guide rod disposed substantially coaxially within said housing member, one end of said spring guide rod being connected to said central portion; and
  (ii) a release spring, at least a portion of which is disposed around said spring guide rod, said spring being compressed when said at least one telescoping member is in a collapsed configuration;

(f) releasable latching means for maintaining said at least one telescoping member in the collapsed configuration, said releaseable latching means comprising a bayonet-type latch which includes:
  (i) a pin extending from said housing member; and
  (ii) a groove in the periphery of said tip member, said groove adapted to receive and releasably retain said pin; and (g) securing means for receiving a user's finger to secure said baton to said user's hand, said securing means comprising a ring rotatably attached to a swivel member, said swivel member being rotatably attached to a side of said handle portion.

2. The baton in accordance with claim 1 comprising two telescoping members, a second telescoping member being slidably disposed within a first telescoping member which is slidably disposed within said housing member.

3. The baton in accordance with claim 2 where said ring comprises a key ring.

4. The baton in accordance with claim 1 wherein said flashlight portion comprises:
  (i) a battery housing attached to the other end of said central portion;
  (ii) a bulb housing connected to said battery housing; and
  (iii) activation means for effecting the illumination of a bulb disposed within said bulb housing.

5. A baton in accordance with claim 4 wherein said activation means comprises a rotatably connected bulb housing for advancing a terminal of a bulb disposed within said bulb housing into electrical contact with a terminal of a battery disposed within said battery housing.

6. The baton in accordance with claim 3 wherein said telescoping members and said housing member are tapered from a larger end to a smaller end.

7. The baton in accordance with claim 6 wherein said means for maintaining said telescoping members in an expanded configuration comprises sizing said larger end of said tapered telescoping member to engage in a friction fit with respect to the smaller end of a surrounding tapered member.

8. The baton in accordance with claim 7 wherein said release spring, when at least partially compressed, extends from said central portion to the end of said second telescoping member when said telescoping members are in said expanded configuration.

* * * * *